US007159386B2

(12) United States Patent
Opris

(10) Patent No.: US 7,159,386 B2
(45) Date of Patent: Jan. 9, 2007

(54) CRANKCASE VENTILATION SYSTEM

(75) Inventor: Cornelius N. Opris, Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 13 days.

(21) Appl. No.: 10/952,100

(22) Filed: Sep. 29, 2004

(65) Prior Publication Data

US 2006/0064966 A1 Mar. 30, 2006

(51) Int. Cl.
*F01N 3/00* (2006.01)
*F01N 3/10* (2006.01)
*F01N 3/02* (2006.01)
*F02M 25/06* (2006.01)

(52) U.S. Cl. ..... 60/283; 60/278; 60/297; 60/299; 60/311

(58) Field of Classification Search ..... 60/283, 60/278, 299, 300, 311, 297; 123/572
See application file for complete search history.

(56) References Cited

U.S. PATENT DOCUMENTS 2,786,457 A * 3/1957 Mickley ..... 123/41.86
3,358,661 A 12/1967 Garner ..... 123/119
3,470,689 A * 10/1969 Gurr ..... 60/307
3,521,429 A * 7/1970 Leffler ..... 96/383
3,641,768 A 2/1972 Cornelius ..... 60/30
3,779,221 A 12/1973 Gartner ..... 123/119
3,846,980 A * 11/1974 DePalma ..... 123/568.12
4,011,846 A 3/1977 Gagliardi ..... 123/119
4,184,858 A 1/1980 Walker ..... 55/228
4,197,703 A * 4/1980 Holmes ..... 60/319
4,415,344 A * 11/1983 Frost et al. ..... 55/523
4,768,493 A 9/1988 Ohtaka et al. ..... 123/573
4,881,511 A 11/1989 Pickering ..... 123/572
4,969,329 A 11/1990 Bolton et al. ..... 60/288
5,024,203 A 6/1991 Hill ..... 123/573
5,205,265 A * 4/1993 Kashiyama et al. ... 123/568.12
5,331,940 A 7/1994 Takayama ..... 123/679
5,456,239 A 10/1995 Henderson et al. ..... 123/563
5,611,204 A 3/1997 Radovanovic et al. ..... 60/605.2
5,669,366 A 9/1997 Beach et al. ..... 123/572
5,711,149 A * 1/1998 Araki ..... 60/278
5,722,376 A 3/1998 Sweeten ..... 123/574
5,803,025 A 9/1998 Feucht ..... 123/41.86
5,878,731 A 3/1999 Bedkowski ..... 123/573
5,911,213 A 6/1999 Ahlborn et al. ..... 123/572
5,937,837 A 8/1999 Shaffer et al. ..... 123/573
6,123,061 A 9/2000 Baker et al. ..... 123/573
6,247,464 B1 6/2001 Maegawa et al. ..... 123/572
6,390,080 B1 5/2002 Dowding et al. ..... 123/572
6,405,721 B1 6/2002 Moren ..... 123/572
6,418,917 B1 7/2002 Bistue ..... 123/572
6,439,174 B1 8/2002 Shea et al. ..... 123/41.86
6,505,615 B1 1/2003 Pietschner ..... 123/572

(Continued)

*Primary Examiner*—Thomas Denion
*Assistant Examiner*—Loren Edwards
(74) *Attorney, Agent, or Firm*—Finnegan, Henderson, Farabow, Garrett & Dunner

(57) ABSTRACT

A crankcase ventilation system may include a first exhaust flow path configured to permit flow of main exhaust gases from a combustion chamber of an internal combustion engine and a particulate trap disposed in the first exhaust flow path. The system may also include a second exhaust flow path configured to enable flow of crankcase gases from a crankcase of the internal combustion engine and to merge the crankcase gases with the main exhaust gases at a point in the first exhaust flow path located downstream of the particulate trap.

12 Claims, 2 Drawing Sheets

U.S. PATENT DOCUMENTS

| | | | | |
|---|---|---|---|---|
| 6,550,718 | B1 | 4/2003 | Maehara | 244/53 |
| 6,557,536 | B1 | 5/2003 | Burgess | 123/572 |
| 6,588,201 | B1 * | 7/2003 | Gillespie | 60/283 |
| 6,659,093 | B1 | 12/2003 | Kim | 123/572 |
| 6,662,795 | B1 | 12/2003 | Baldwin et al. | 123/676 |
| 6,672,050 | B1 | 1/2004 | Murata et al. | |
| 6,691,687 | B1 | 2/2004 | Liang et al. | 123/572 |
| 6,729,125 | B1 * | 5/2004 | Suga et al. | 60/285 |
| 2001/0022175 | A1 | 9/2001 | Moren | |
| 2002/0185009 | A1 | 12/2002 | Schlaps | |
| 2003/0140909 | A1 | 7/2003 | Criddle | |

* cited by examiner

CRANKCASE VENTILATION SYSTEM

TECHNICAL FIELD

This disclosure is directed to an exhaust system for internal combustion engines and, more particularly, to a crankcase ventilation system for internal combustion engines.

BACKGROUND

In internal combustion engines, including diesel and gasoline engines, a fuel and air mixture is combusted in combustion cylinders. Reciprocating pistons in the combustion cylinders are moved between top dead center and bottom dead center positions by a crankshaft below the cylinders in a crankcase. As each piston moves toward its top dead center position, it compresses the fuel and air mixture in the combustion chamber above the piston. The compressed mixture combusts and expands, driving the piston downward toward its bottom dead center position.

Combustion in the cylinder releases energy and generates combustion products and by-products, most of which are exhausted from the cylinder into an exhaust system of the engine during the exhaust phase of the combustion cycle. However, some of the combustion products enter into the crankcase by blowing past seal rings around the pistons, and are thus termed "blow-by gases" or simply "blow-by." Blow-by gases contain contaminants normally found in exhaust gases, such as, for example, hydrocarbons (HC), carbon monoxide (CO), $NO_x$, soot, and unburned or partially burned fuel. In addition, because the crankcase is partially filled with lubricating oil being agitated at high temperatures, the blow-by gases may also contain oil droplets and oil vapor.

As blow-by gases build up in the crankcase, they must be vented to relieve pressure in the crankcase. Some systems vent the blow-by gases directly to the atmosphere. However, the contaminants in blow-by gases are harmful to the environment. Therefore, emissions concerns make direct atmospheric venting a poor option under most, if not all, operating conditions.

Normally aspirated engines have been developed that direct the crankcase gases back to the intake of the engine and mix them with the fuel and air mixture as it flows into the combustion chamber where the contaminants are mostly burned or oxidized during combustion. However, in an engine with forced induction, returning crankcase gases to the intake side of a compressor in a supercharger or turbocharger can result in fouling of the compressor wheel in a relatively short time period. Therefore, crankcase gases must undergo extensive purification before returning them to the intake in a supercharged or turbocharged engine. Further, even with extensive purification, some level of contamination may still exist that may be harmful to the supercharger or turbocharger or various engine components.

Systems have been developed for engines with forced induction that vent the crankcase gases to the atmosphere after the purification process, rather than introducing them back into the engine for further combustion and potentially fouling or otherwise inhibiting the performance of the supercharger or turbocharger. For example, U.S. Pat. No. 6,691,687, issued to Liang et al. on Feb. 17, 2004 ("Liang"), teaches a crankcase blow-by filtration system. In the system of Liang, crankcase gases are purified with a particle and droplet filter. These gases are heated parasitically via heat exchange with some of the main exhaust gases from the engine and also with an electrical heating element. These gases are further treated with a catalytic soot filter before being released to the atmosphere.

While the system of Liang successfully releases purified crankcase gases to the atmosphere, this system is complex. For example, the system of Liang includes multiple purification stages, additional structure for the parasitic heating, an additional energy source for the electrical heating element, and a catalytic filter dedicated to the crankcase gases. Each of these structures is separate from and in addition to the main exhaust path.

The disclosed control system is directed toward improvements and simplification of the system set forth above.

SUMMARY OF THE INVENTION

In one aspect, the present disclosure is directed to a crankcase ventilation system. The system may include a first exhaust flow path configured to permit flow of main exhaust gases from a combustion chamber of an internal combustion engine and a particulate trap disposed in the first exhaust flow path. The system may also include a second exhaust flow path configured to enable flow of crankcase gases from a crankcase of the internal combustion engine and to merge the crankcase gases with the main exhaust gases at a point in the first exhaust flow path located downstream of the particulate trap.

In another aspect, the present disclosure is directed to a crankcase ventilation system including a first exhaust flow path configured to permit flow of main exhaust gases from a combustion chamber of an internal combustion engine. The system may include a particulate trap disposed in the first exhaust flow path. The system may further include a second exhaust flow path configured to enable flow of crankcase gases from a crankcase of the internal combustion engine and to merge the crankcase gases with the main exhaust gases at a point in the first exhaust flow path located downstream of the particulate trap. The system may also include a first catalyst configured to catalyze the crankcase gases and a second catalyst configured to catalyze the main exhaust gases. In addition, the first catalyst may be heated.

In another aspect, the present disclosure is directed to a method for crankcase ventilation. The method may include venting crankcase gases from a crankcase of an internal combustion engine and routing the crankcase gases away from the crankcase in a first conduit. Exhaust gases from one or more combustion chambers of the internal combustion engine may be vented and routed away from the one or more combustion chambers in a second conduit. Particulates may be filtered from the exhaust gases with a particulate trap and crankcase gases may be merged with the filtered exhaust gases at a point downstream from the particulate trap.

DETAILED DESCRIPTION

Reference will now be made in detail to the drawings. Wherever possible, the same reference numbers will be used throughout the drawings to refer to the same or like parts.

Figure 1:
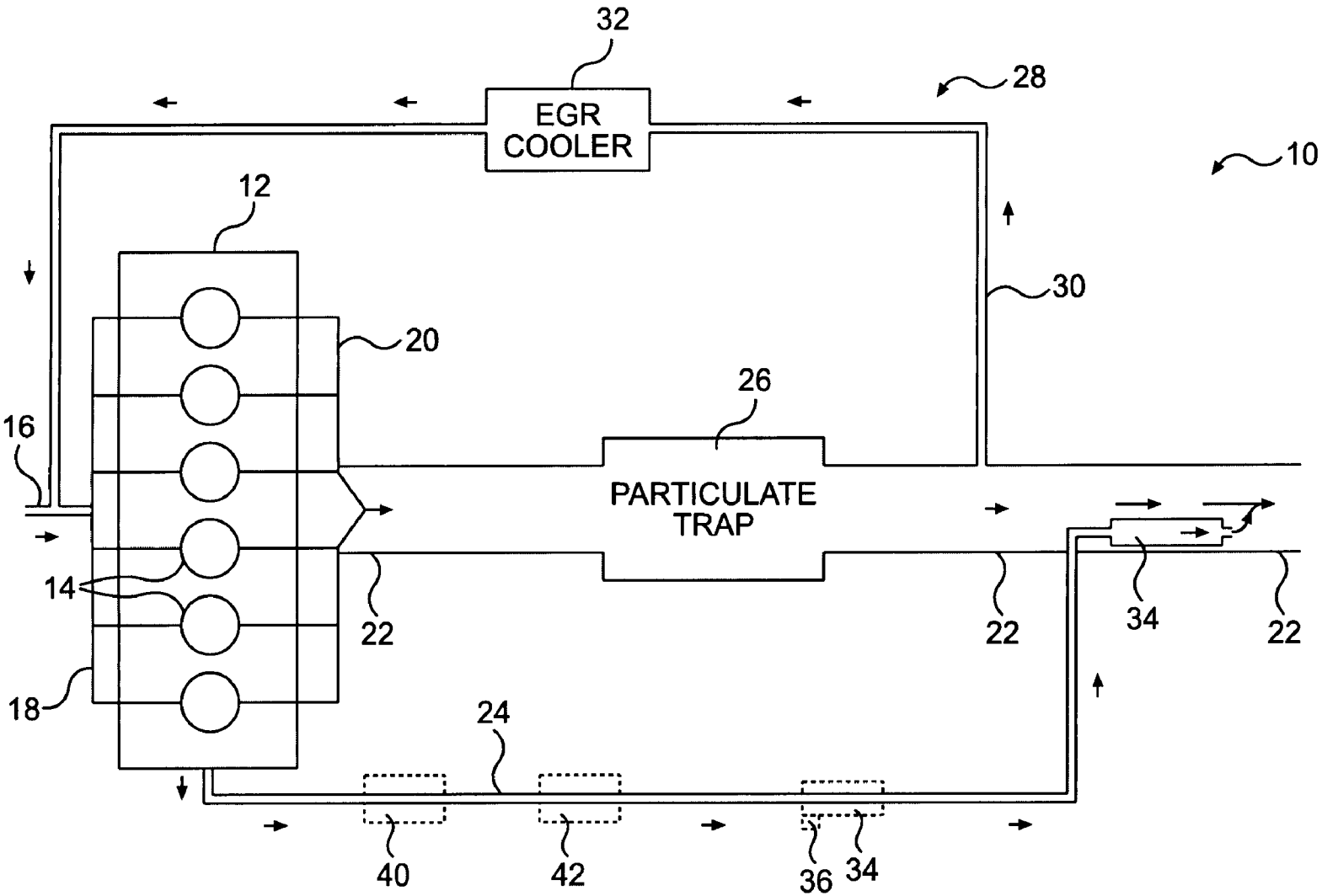
FIG. 1 is a schematic representation of a crankcase ventilation system according to an exemplary disclosed embodiment.

FIG. 1 illustrates an exemplary crankcase ventilation (CCV) system 10. CCV system 10 may include an internal combustion engine 12. Engine 12 may include combustion cylinders 14, and may have intake and exhaust components attached to it, such as, for example, an air intake 16, an intake manifold 18, an exhaust manifold 20, a main exhaust conduit 22, and a CCV conduit 24.

Engine 12 may be any kind of internal combustion engine. For example, engine 12 may be a gasoline engine or a diesel engine. Further, engine 12 may be naturally aspirated or may include forced induction such as turbocharging or supercharging.

CCV system 10 may include one or more exhaust treatment devices for reducing emissions in the exhaust gas from engine 12. In particular, CCV system 10 may include a particulate trap 26 and an exhaust gas recirculation (EGR) system 28, which may include an EGR conduit 30 and an EGR cooler 32.

Particulate trap 26 may be any kind of exhaust filter configured to remove particulate matter, such as soot and/or ash, from exhaust gases. For example, particulate trap 26 may be a mesh, screen, etc.

Particulate trap 26 may also be catalytic. Alternatively, a catalytic unit, separate from particulate trap 26, may be included to catalyze gases flowing through main exhaust conduit 22. The catalyst used for a catalytic particulate trap 26 or a separate catalytic unit may be an oxidation catalyst, such as a diesel oxidation catalyst, configured to remove (i.e., oxidize) pollutants such as hydrocarbons (HC) and/or carbon monoxide (CO). Alternatively or in addition, a reduction catalyst may be included for removing (i.e., reducing) pollutants such as $NO_x$.

CCV conduit 24 may be configured to direct the flow of crankcase gases ventilated from the crankcase of engine 12 (CCV gases) to main exhaust conduit 22 where the CCV gases may be merged with the main exhaust gases in main exhaust conduit 22. CCV gases may be merged with the main exhaust at a location downstream from particulate trap 26. Because the pressure of the exhaust gases in main exhaust conduit 22 downstream from particulate trap 26 may be lower than the pressures within the crankcase of engine 12, CCV gases may flow from the crankcase to main exhaust conduit 22 without the aid of a pump.

CCV gases may be catalyzed before venting to the atmosphere. For example, CCV system 10 may include a separate CCV catalytic unit 34, which may catalyze CCV gases prior to being released into the main exhaust flow in main exhaust conduit 22. The catalyst used for a CCV catalytic unit 34 may be an oxidation catalyst configured to remove (i.e., oxidize) pollutants such as hydrocarbons (HC) and/or carbon monoxide (CO). Alternatively or in addition, a reduction catalyst may be included for removing (i.e., reducing) pollutants such as $NO_x$. Further, CCV catalytic unit 34 may be configured to remove soluble organic fraction (SOF), which is primarily engine oil.

Because CCV gases may be cooler than desired for maintaining CCV catalytic unit 34 at a desired operating temperature (e.g., at least about 150 degrees Celsius), CCV system 10 may be configured to provide additional heating of CCV catalytic unit 34. For example, CCV catalytic unit 34 may be heated parasitically from the heat of the main exhaust gases. In an exemplary embodiment, CCV catalytic unit 34 may be housed within main exhaust conduit 22, as shown in FIG. 1. By housing CCV catalytic unit 34 within main exhaust conduit 22, at least some of the heat from the exhaust gases in main exhaust conduit 22 may be transferred to CCV catalytic unit 34. In this embodiment, CCV catalytic unit 34 may be maintained above a desired operating temperature without using an external heating device (e.g., an electrical heating element). In a similar configuration, CCV catalytic unit 34 may be disposed adjacent to main exhaust conduit 22 such that heat from the main exhaust gases is transferred to CCV catalytic unit 34.

Alternatively, CCV catalytic unit 34 may be located away from main exhaust conduit 22. In this configuration, a heating device 36 may be included to maintain CCV catalytic unit 34 at a desired operating temperature. Heating device 36 may be any type of heating device including, for example, electrical heating elements, burners, etc. Further, heating device 36 may be integral or non-integral with CCV catalytic unit 34.

In lieu of or in addition to heating device 36, CCV system 10 may include a pump 40 for compressing CCV gases. Compressing CCV gases will raise their temperature, and thus perform at least partially the function of heating device 36. Compressed CCV gases may be held in a chamber 42 and released at a controlled rate to CCV catalytic unit 34.

EGR system 28 may extract main exhaust gases from main exhaust conduit 22 and direct them back to air intake 16 where they may be reintroduced into the combustion chambers of engine 12. By undergoing the combustion process again, more of the contaminants may be removed, thus reducing emissions further. Accordingly, the disclosed EGR system may also be referred to as clean exhaust induction (CEI).

Also, because exhaust gases typically have high temperatures, EGR system 28 may include EGR cooler 32 in order to avoid performance losses due to the lower amount of oxygen in hotter gases. EGR cooler 32 may cool EGR gases in any conventional manner to a lower temperature and thus a greater density. Higher density gases have higher levels of all gaseous components and thus more oxygen, which may increase performance of engine 12.

In addition, EGR gases should be as clean as possible before recirculation to avoid damaging EGR cooler 32 and various engine components. Therefore, EGR conduit 30 may extract gases from a location downstream of particulate trap 26 and any catalytic unit not integral therewith. By doing so, the amount of particulates that may be reintroduced to engine 12 may be reduced. Also, EGR conduit 30 may extract gases from a location upstream from the point where the CCV gases are merged with the main exhaust gases in main exhaust conduit 22. This may avoid recirculation of additional contaminants from CCV gases.

Figure 2:
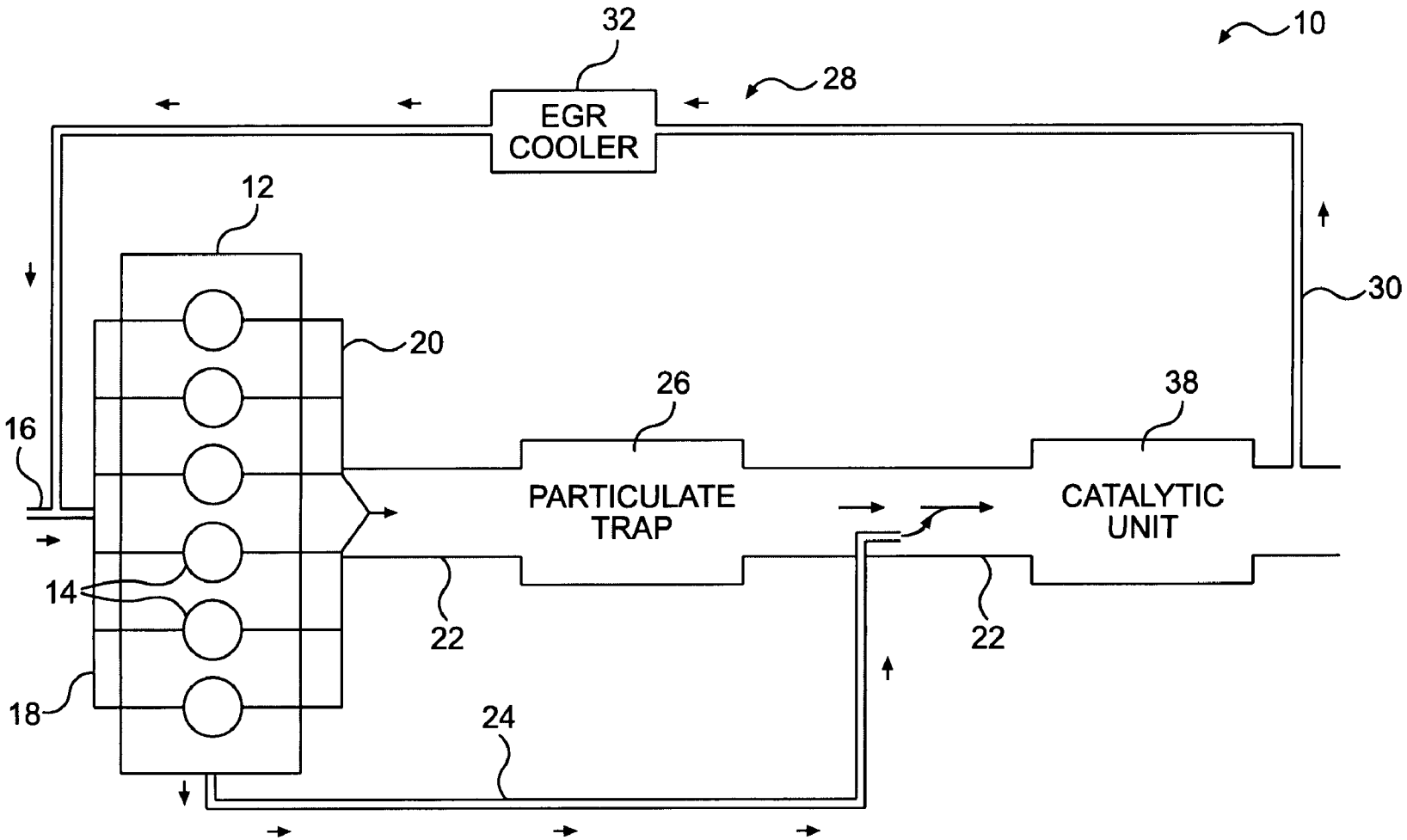
FIG. 2 is a schematic representation of a crankcase ventilation system according to another exemplary disclosed embodiment.

FIG. 2 illustrates an exemplary embodiment, wherein both the main exhaust gases and the CCV gases may be catalyzed by the same catalytic unit. As shown in FIG. 2, a catalytic unit 38 may be positioned downstream from the point where the CCV gases are merged with the main exhaust gases. EGR conduit 30 may extract gases from main exhaust conduit 22 downstream of catalytic unit 38, in order to insure that the EGR gases are as clean as possible.

INDUSTRIAL APPLICABILITY

The disclosed crankcase ventilation system may be employed on any type of internal combustion engine to reduce overall emissions to the environment while extending the usable lifetime of engine and exhaust system components. By routing CCV gases to main exhaust conduit 22 rather than to air intake 16 or upstream of particulate trap 26, the useable lifetimes of engine components, and particularly any turbochargers or superchargers that may be part of the engine's induction system, may be extended. Also, by routing the CCV gases downstream of particulate trap 26, the usable lifetime of particulate trap 26 can be extended. Otherwise, if CCV gases were routed upstream of particulate trap 26, over time, contaminants within the CCV gases, particularly oil vapor and droplets, may clog the particulate trap 26 or otherwise render it ineffective.

Further, by routing CCV gases downstream of particulate trap 26, the ash service interval of particulate trap 26 may be extended. Engine oil, particularly for diesel engines, may contain a small amount of ash, which is used to enhance the lubricity of the oil. This ash can be present in exhaust gases. Because some exhaust gases blow by into the crankcase, CCV gases from the crankcase may also contain some of this ash. However, this ash may only be present in CCV gases in very small amounts, which are essentially immeasurable on a conventional emissions test. But, if CCV gases are directed into the main exhaust upstream from a particulate trap, over many miles of operation (e.g., 250,000 miles) this ash can build up on the particulate trap. Therefore, by routing the CCV gases downstream of particulate trap 26 the disclosed system may avoid contributing to ash buildup on particulate trap 26 without appreciably adding to the overall emissions of engine 12. Accordingly, by avoiding additional ash buildup, particulate trap 26 may not need to be cleaned as frequently.

In addition, because the CCV gases may be routed downstream of particulate trap 26 where the pressure is relatively low, no pump is required to transport the gases from the crankcase to main exhaust conduit 22. When CCV gases are routed upstream of a particle filter, a pump may be required because the particle filter can create back pressure in the main exhaust, which can be higher than that in the crankcase.

It will be apparent to those skilled in the art that various modifications and variations can be made to the disclosed crankcase ventilation system without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A crankcase ventilation system comprising:

a first exhaust flow path configured to permit flow of main exhaust gases from a combustion chamber of an internal combustion engine;

a particulate trap disposed in the first exhaust flow path; and a second exhaust flow path configured to enable flow of crankcase gases from a crankcase of the internal combustion engine and to merge the crankcase gases with the main exhaust gases;

a catalyst located in the main exhaust path and configured to catalyze both the crankcase gases and the main exhaust gases; and an exhaust gas recirculation system configured to extract exhaust gases from a location downstream of the catalyst and direct the extracted exhaust gases back to an air intake of the engine.

2. The system of claim 1, wherein the exhaust gas recirculation system includes an exhaust gas recirculation cooler configured to lower temperatures of exhaust gases directed to the air intake of the engine.

3. The system of claim 1, wherein the engine is naturally aspirated.

4. The system of claim 1, wherein the engine includes a forced induction system.

5. The system of claim 4, wherein the forced induction system includes a turbocharger.

6. The system of claim 4, wherein the forced induction system includes a supercharger.

7. A method for crankcase ventilation comprising:

venting crankcase gases from a crankcase of an internal combustion engine;

routing the crankcase gases away from the crankcase in a first conduit;

venting exhaust gases from one or more combustion chambers of the internal combustion engine;

routing the exhaust gases away from the one or more combustion chambers in a second conduit;

filtering particulates from the exhaust gases with a particulate trap; and merging the crankcase gases with the filtered exhaust gases;

catalyzing both the exhaust gases and the crankcase gases with a catalyst located in the path of the second conduit; and extracting a portion of gases from the second conduit at a location downstream of the catalyst and directing the extracted gases back to an air intake of the engine.

8. The method of claim 7, further including cooling the exhaust gases directed to the air intake of the engine.

9. The system of claim 7, wherein the engine is naturally aspirated.

10. The system of claim 7, wherein the engine includes a forced induction system.

11. The system of claim 10, wherein the forced induction system includes a turbocharger.

12. The system of claim 10, wherein the forced induction system includes a supercharger.

* * * * *